US010760261B2

(12) United States Patent
Richards

(10) Patent No.: US 10,760,261 B2
(45) Date of Patent: Sep. 1, 2020

(54) BEAM-TO-COLUMN CONNECTION SYSTEMS AND MOMENT-RESISTING FRAMES INCLUDING THE SAME

(71) Applicant: DURAFUSE FRAMES, LLC, West Jordan, UT (US)

(72) Inventor: Paul Williams Richards, Orem, UT (US)

(73) Assignee: DURAFUSE FRAMES, LLC, West Jordan, UT (US)

( * ) Notice: Subject to any disclaimer, the term of this patent is extended or adjusted under 35 U.S.C. 154(b) by 0 days.

(21) Appl. No.: 15/516,834

(22) PCT Filed: Dec. 8, 2016

(86) PCT No.: PCT/US2016/065623

§ 371 (c)(1),
(2) Date: Apr. 4, 2017

(87) PCT Pub. No.: WO2017/100453

PCT Pub. Date: Jun. 15, 2017

(65) Prior Publication Data

US 2018/0274223 A1 Sep. 27, 2018

Related U.S. Application Data

(60) Provisional application No. 62/265,362, filed on Dec. 9, 2015.

(51) Int. Cl.
*E04B 1/98* (2006.01)
*E04B 1/24* (2006.01)
(Continued)

(52) U.S. Cl.
CPC ..... *E04B 1/2403* (2013.01); *E04C 3/06* (2013.01); *E04C 3/32* (2013.01); *E04H 9/021* (2013.01);
(Continued)

(58) Field of Classification Search
CPC ..... E04B 1/08; E04B 1/18; E04B 1/19; E04B 1/1903; E04B 2001/1936; E04B 1/24;
(Continued)

(56) References Cited

U.S. PATENT DOCUMENTS 1,727,293 A 9/1929 Andrew
4,014,089 A 3/1977 Sato et al.
(Continued)

FOREIGN PATENT DOCUMENTS

JP 2000144901 A 5/2000
KR 20040106829 A 12/2004
(Continued)

OTHER PUBLICATIONS

International Search Report and Written Opinion from International Application No. PCT/US16/65623 dated Mar. 10, 2017.
(Continued)

*Primary Examiner* — Phi D A
(74) *Attorney, Agent, or Firm* — Dorsey & Whitney LLP

(57) ABSTRACT

Embodiments disclosed herein relate to a beam-to-column connection systems for a moment-resisting frame as well as moment-resisting frames that include such connection systems.

21 Claims, 8 Drawing Sheets

(51) Int. Cl.

| | |
|---|---|
| ***E04H 9/02*** | (2006.01) |
| ***E04C 3/06*** | (2006.01) |
| ***E04C 3/32*** | (2006.01) |
| *E04C 3/04* | (2006.01) |

(52) U.S. Cl.
CPC ..... *E04B 2001/2415* (2013.01); *E04B 2001/2418* (2013.01); *E04B 2001/2442* (2013.01); *E04B 2001/2448* (2013.01); *E04C 2003/0421* (2013.01); *E04C 2003/0434* (2013.01); *E04C 2003/0452* (2013.01)

(58) Field of Classification Search
CPC ..... E04B 1/2403; E04B 2001/2472; E04B 2001/2457; E04B 2001/2448; E04B 2001/2415; E04B 2001/2469; E04B 3/32; E04B 2003/0426; E04B 2003/0413; E04B 2003/0408; E04C 3/06; E04C 3/32; E04C 2003/0421; E04C 2003/0434; E04C 2003/0452
See application file for complete search history.

(56) References Cited

U.S. PATENT DOCUMENTS

| | | | | |
|---|---|---|---|---|
| 5,148,642 | A | 9/1992 | Plumier et al. | |
| 5,660,017 | A | 8/1997 | Houghton | |
| 6,138,427 | A | 10/2000 | Houghton | |
| 8,800,239 | B2 | 8/2014 | Yang | |
| 9,091,065 | B2 | 7/2015 | Tran et al. | |
| 9,200,442 | B2 | 12/2015 | Richards | |
| 9,506,239 | B2 | 11/2016 | Houghton | |
| 10,316,507 | B2 | 6/2019 | Richards | |
| 2002/0184836 | A1 | 12/2002 | Takeuchi et al. | |
| 2004/0050013 | A1 | 3/2004 | Okada et al. | |
| 2004/0144006 | A1 | 7/2004 | Chu | |
| 2004/0200178 | A1 | 10/2004 | Simmons | |
| 2005/0204684 | A1* | 9/2005 | Houghton | E04B 1/24 52/653.1 |
| 2006/0144006 | A1* | 7/2006 | Suzuki | E04B 1/2403 52/655.1 |
| 2006/0265992 | A1* | 11/2006 | Hiragaki | E04B 1/2403 52/633 |
| 2009/0223166 | A1 | 9/2009 | Ohata et al. | |
| 2010/0205891 | A1 | 8/2010 | Bong et al. | |
| 2011/0030305 | A1* | 2/2011 | Karns | E04B 1/2403 52/650.1 |
| 2014/0182234 | A1 | 7/2014 | Yang | |
| 2014/0325932 | A1 | 11/2014 | Karns et al. | |
| 2015/0096244 | A1 | 4/2015 | Richards | |
| 2015/0275501 | A1 | 10/2015 | Houghton | |
| 2016/0356033 | A1 | 12/2016 | Houghton et al. | |
| 2018/0266099 | A1 | 9/2018 | Lippert | |
| 2018/0274223 | A1 | 9/2018 | Richards | |

FOREIGN PATENT DOCUMENTS

| | | | |
|---|---|---|---|
| KR | 100516332 | B1 | 9/2005 |
| WO | 2014085680 | A1 | 6/2014 |
| WO | 2016036564 | A1 | 3/2016 |
| WO | 2017100453 | A1 | 6/2017 |

OTHER PUBLICATIONS

International Search Report and Written Opinion from International Application No. PCT/US2015/047006 dated Nov. 23, 2015.
Non-Final Office Action for U.S. Appl. No. 15/500,991 dated Jan. 18, 2018.
Notice of Allowance for U.S. Appl. No. 15/500,991 dated Jun. 18, 2018.
Notice of Allowance for U.S. Appl. No. 15/500,991 dated Oct. 2, 2018.
U.S. Appl. No. 15/516,834, filed Apr. 4, 2017.
U.S. Appl. No. 62/265,362, filed Dec. 9, 2015.
U.S. Appl. No. 62/549,853, filed Aug. 24, 2017.
Corrected Notice of Allowance for U.S. Appl. No. 15/500,991 dated May 8, 2019.
International Search Report and Written Opinion for International Application No. PCT/US2018/046222 dated Nov. 14, 2018.
U.S. Appl. No. 15/500,991, filed Feb. 1, 2017.
U.S. Appl. No. 62/044,738, filed Sep. 2, 2014.
Issue Notification for U.S. Appl. No. 15/500,991 dated May 22, 2019.
Non-Final Office Action for U.S. Appl. No. 16/101,075 dated Jun. 27, 2019.
Corrected Notice of Allowance for U.S. Appl. No. 16/394,665 dated Feb. 11, 2020.
Issue Notification for U.S. Appl. No. 16/394,665 dated Feb. 19, 2020.
Notice of Allowance for U.S. Appl. No. 16/101,075 dated Feb. 2020.
Notice of Allowance for U.S. Appl. No. 16/394,665 dated Oct. 30, 2019.
Supplemental Notice of Allowability for U.S. Appl. No. 16/101,075 dated May 28, 2020.

* cited by examiner

BEAM-TO-COLUMN CONNECTION SYSTEMS AND MOMENT-RESISTING FRAMES INCLUDING THE SAME

CROSS-REFERENCE TO RELATED APPLICATIONS

This application claims priority to U.S. Provisional Application No. 62/265,362 filed on 9 Dec. 2015, the disclosure of which is incorporated herein, in its entirety, by this reference.

BACKGROUND

Typically, structural beam-to-column connections in moment-resisting frames can be very expensive to build, because they include multiple parts that must be fitted and then welded together. For example, the parts required for the moment-resisting frame may include a column, column continuity plates, column doubler plates, and a beam. The welding between the beam and the column is typically performed in the field and can be particularly expensive. Another connection type includes a flange-plate moment connection and addresses the expense of welding. Generally, however, when the frame experiences a seismic event, the connection between the beam and the column is such that the failure or yielding of the frame occurs at a location on the beam, which is near but not at the connection.

Accordingly, designers and manufacturers of moment-resisting frame continue to seek improvements thereto.

SUMMARY

Embodiments disclosed herein relate to a seismic fuse plate for a moment-resisting frame as well as to a connection system and a moment-resisting frame that include such seismic fuse plate. Specifically, the seismic fuse plate may be configured and positioned such that movement or tilting of the moment-resisting frame exerts shear forces on one or more portions of the seismic fuse plate. For example, as the moment-resisting frame experiences a seismic event (e.g., an event that may exert forces onto the moment-resisting frame, which may tilt or reconfigure the moment-resisting frame from a generally rectangular configuration to a parallelogram configuration), the seismic fuse plate may be subjected to shear force that may preferentially fail the seismic fuse plate instead of the beam and/or column connected by the connection system that includes the seismic fuse plate.

An embodiment includes beam-to-column connection system that includes a first pair of splice plates configured to be secured to the column and to be spaced from each other along the column at a first distance, and a second pair of splice plates configured to be secured to the column and opposite to the first pair of splice plates, and to be spaced from each other along the column at the first distance. The beam-to-column connection system also includes a first seismic fuse plate that includes a beam-connection portion configured to connect to a first flange of the beam, a first splice-connection portion longitudinally extending along at least a portion of the beam-connection portion and being configured to connect to and between the first pair of splice plates, and a second splice-connection portion longitudinally extending along at least a portion of the beam-connection portion and being configured to connect to and between the second pair of splice plates at a second location, the distance between the first and second location being greater than the width of the beam. The first seismic fuse plate also includes a first shear portion extending between the first splice-connection portion and the beam-connection portion.

Another embodiment includes a moment-resisting frame that includes a column having a column width, a beam having a beam width, and a beam-to-column connection system connecting the beam to the column. The beam-to-column connection system includes a first pair of splice plates connected to a first side of the column and spaced from each other along the first side of the column at a first distance, a second pair of splice plates connected to a second side of the column and spaced from each other along the first side of the column at the first distance, and a first seismic fuse plate secured between the first pair of splice plates and between the second pair of splice plates. The first seismic fuse plate includes a beam-connection portion connected to the a first flange of the beam, and a first shear portion located between the beam-connection portion and the first pair of splice plates.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1:
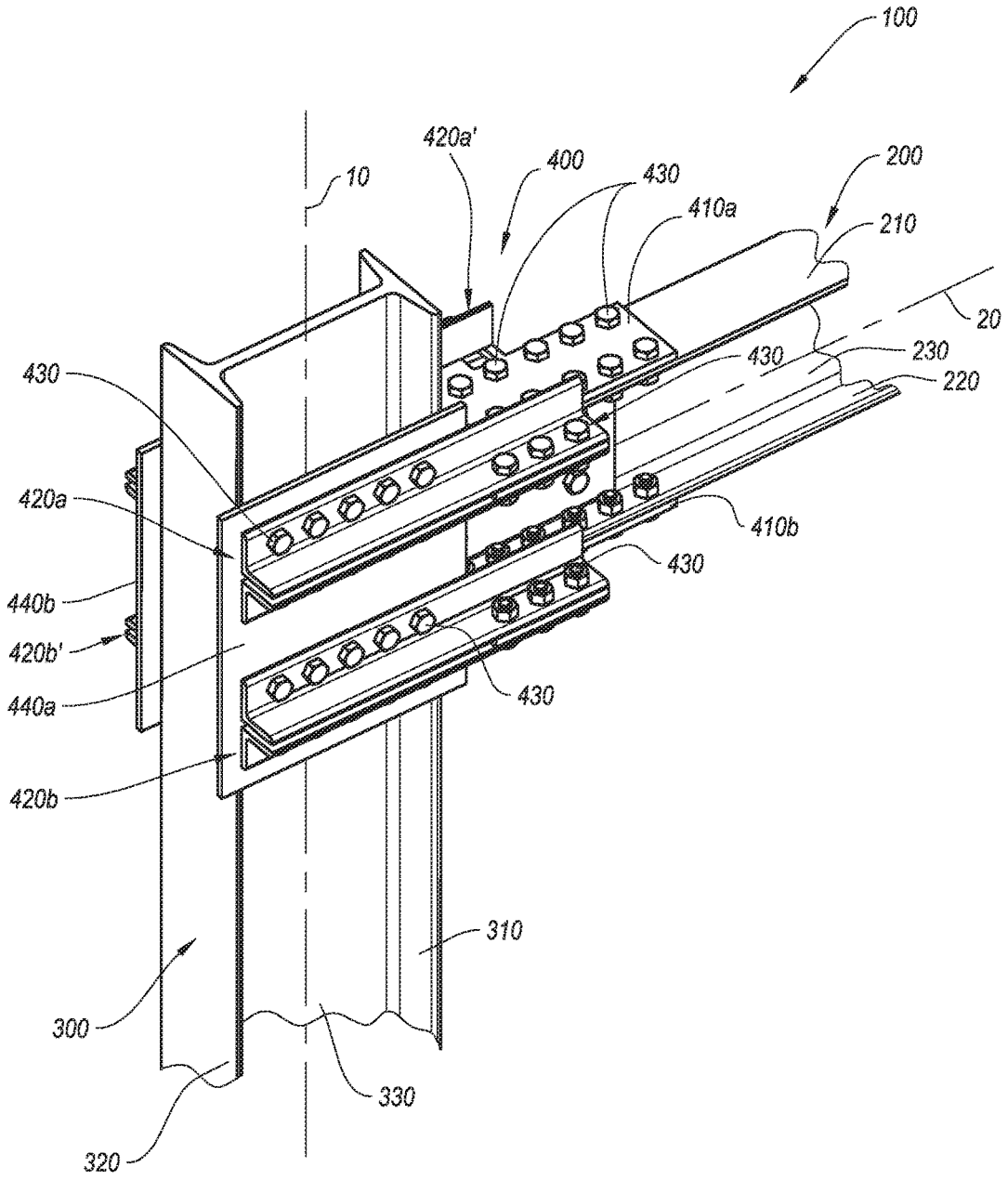
FIG. 1 is an isometric partial view of a moment-resisting frame, according to an embodiment.

Embodiments disclosed herein relate to a seismic fuse plate for a moment-resisting frame as well as to a connection system and a moment-resisting frame that includes such seismic fuse plate. Specifically, the seismic fuse plate may be configured and positioned such that movement or tilting of the moment-resisting frame exerts shear forces on one or more portions of the seismic fuse plate. For example, as the moment-resisting frame experiences a seismic event (e.g., an event that may exert forces onto the moment-resisting frame, which may tilt or reconfigure the moment-resisting frame from a generally rectangular configuration to a parallelogram configuration), the seismic fuse plate may be subjected to shear force that may preferentially fail the seismic fuse plate instead of the beam and/or column connected by the connection system that includes the seismic fuse plate.

In some embodiments, the connection system may be configured to prevent or reduce the likelihood of buckling at one or more portions of the beam and/or column connected by the connection system. For example, failure resulting from shear forces experienced by the seismic fuse plate at the connection system may accommodate or allow greater relative rotation or pivoting between the beam and column connected by the connection system (e.g., as compared with a conventional connection system) without failure of the beam and/or column. Facilitating increased tilting between the beam and column connected by the connection system (compared with a conventional connection) without buckling the beam and/or column may prevent failure or deformation of the beam (e.g., which may be more costly to repair than repairing or replacing the connection system). For example, instead of buckling or otherwise plastically deforming the beam, during a seismic event, the seismic fuse plate may experience elastic and/or plastic deformation resulting from the shear forces experienced thereby, while the deformations experienced by the beam and the column may remain in the elastic region, thereby preventing damage to the beam and column. Moreover, one or more portions of the connection system (e.g., the seismic fuse plate) may be replaced. As noted above, replacing a failed or plastically deformed seismic fuse plate may be easier and/or less expensive than replacing a failed or plastically deformed beam or column.

Generally, the seismic fuse plate may have any number of suitable configurations, such that the seismic fuse plate may be subjected to and/or fail due to shear forces (e.g., in a seismic event) of a selected magnitude. For example, the seismic fuse plate may include at least one shear portion that may selectively fail during a seismic event, may have any suitable shape and/or cross-section that may have a suitable shear strength. Hence, for example, by selecting a suitable shear strength for the shear portion(s) of the seismic fuse plate, the moment-resisting frame may be configured such as to fail due to the shear forces applied at the shear portion of the seismic fuse plate, while the column and beam connected by the connection system may remain undamaged.

FIG. 1 is an isometric partial view of a moment-resisting frame 100 according to an embodiment. Specifically, the moment-resisting frame 100 illustrated in FIG. 1 includes a beam 200 connected to a column 300 by a beam-to-column connection system 400. As described above, the beam-to-column connection system 400 may include one or more seismic fuse plates, such as first and second seismic fuse plates 410*a*, 410*b*, which may selectively fail or elastically deform during a seismic event, thereby absorbing energy (e.g., in the a manner that may protect or prevent plastic deformation of the beam 200 and/or of the column 300).

Generally, the beam-to-column connection system 400 may include any number of suitable connections that may be configured to connect the first seismic fuse plate 410*a* and/or second seismic fuse plate 410*b* to the column 300. In the illustrated embodiment, the first seismic fuse plate 410*a* may be connected to the column 300 by opposing first and second pairs of splice plates 420*a*, 420*a*'. Similarly, the seismic fuse plate 410*b* may be connected to the column 300 by opposing third pair of splice plates 420*b* and fourth pairs of splice plates 420*b*'. In the illustrated embodiment, multiple respective fasteners (e.g., bolts 430) may connect the first and second pairs of splice plates 420*a*, 420*a*' to the first seismic fuse plate 410*a*. Likewise, in the illustrated embodiment, the first seismic fuse plate 410*a* may be connected to the beam 200 with multiple fasteners (e.g., bolts 430). Similarly, the seismic fuse plate 410*b* may be connected to the third pair of splice plates 420*b* and to the fourth splice plate (not visible in the FIG. 1) by one or more fasteners, such as by bolts 430.

The first and second pairs of splice plates 420*a* and 420*a*' may extend outward from the column 300 (e.g., generally in the direction of the beam 200). In the illustrated embodiment, the beam-to-column connection system 400 may include doubler plates 440*a*, 440*b* that may be secured to the column 300. For example, the doubler plates 440*a*, 440*b* may be welded or otherwise secured to the column 300 with any number of suitable fastening mechanisms (e.g., fasteners, such as bolts, rivets, etc., welds, etc.). In an embodiment, the first pair of splice plates 420*a* may be secured to the doubler plate 440*a* (e.g., the first pair of splice plates 420*a* may be fastened to the 440*a* with one or more fasteners, such as with bolts 430). Similarly, the second first pair of splice plates 420*a*' may be connected to the 440*b* (e.g., the second first pair of splice plates 420*a*' may be fastened to the 440*b* with one or more fasteners, such as with one or more bolts).

Also, the third pair of splice plates 420*b* may be secured to the doubler plate 440*a* with one or more fasteners (e.g., with one or more bolts 430). Hence, for example, the first pair of splice plates 420*a* and the third pair of splice plates 420*b* may be positioned on the same side of the column 300 and may be spaced apart from each other. Moreover, the second pair of splice plates 420*a*' and the fourth pair of splice plates 420*b*' may be located on the same side of the column 300 (e.g., opposite to the respective first pair of splice plates 420*a* and the third pair of splice plates 420*b*). Similarly, the second pair of splice plates 420*a*' and the fourth splice plates may be spaced apart along the column 300 (e.g., the second first pair of splice plates 420*a*' may have generally the same longitudinal position along the column 300 as the first pair of splice plates 420*a*, and the fourth pair of splice plates 420*b*' may have generally the same longitudinal position along the column 300 as the 420*b*).

In the illustrated embodiment, the first pair of splice plates 420*a* is positioned above the third pair of splice plates 420*b* along the column 300. For example, the first pair of splice plates 420*a* may secure a portion of the first seismic fuse plate 410*a*, and the third pair of splice plates 420*b* may secure a portion of the seismic fuse plate 410*b*. The first seismic fuse plate 410*a* may be spaced apart from (e.g., positioned above) the first seismic fuse plate 410*b*, such that the beam 200 may be positioned between the first and second seismic fuse plates 410*a*, 410*b* and secured thereto. For example, as described above the first and second seismic fuse plates 410*a*, 410*b* may secure the beam 200 to the column, such that the beam 200 is secured between the first and second seismic fuse plates 410*a*, 410*b*.

The beam 200 may be an I-beam that has a top flange 210, a bottom flange 220, and a web 230 extending therebetween. It should be appreciated that the beam 200 may have any number of suitable shapes (e.g., round tube, square tube, etc.). In the embodiment shown in FIG. 1, the first seismic fuse plate 410*a* may be secured to the top flange 210, and the seismic fuse plate 410*b* may be secured to the bottom flange 220 of the beam 200 (e.g., the beam 200 may be oriented relative to the column 300, such that the top flange 210 and the bottom flange 220 are spaced from each other along a direction that is generally parallel to the longitudinal direction of the column 300). Hence, for example, the first seismic fuse plate 410*a* and seismic fuse plate 410*b* may position and orient the beam 200 at a suitable orientation and position relative to the column 300.

Generally, the first seismic fuse plate 410*a* and the second seismic fuse plate 410*b* may extend outward from the column 300 in the same direction as the beam 200. In the illustrated embodiment, the first seismic fuse plate 410*a* and the second seismic fuse plate 410*b* orient the beam 200 substantially perpendicularly relative to the column 300 (e.g., the column 300 may be oriented along a substantially vertical axis 10, the beam 200 may be oriented generally along a substantially horizontal axis 20, and the vertical and horizontal axes 10, 20 may be substantially perpendicular to each other). In additional or alternative embodiments, the beam 200 may be oriented at any suitable angle relative to the column 300 (e.g., at obtuse or acute angles relative to the column 300). For example, the first, second, and third pairs of splice plates 420*a*, 420*a*', 420*b*, and the fourth splice plates may be secured to the corresponding doubler plates 440*a*, 440*b*, such as to form a suitable angle relative to the column 300 and to orient the beam 200 at the suitable angle relative to the column 300.

The first and second pairs of splice plates 420*a*, 420*a*', and the third and fourth pairs of splice plates 420*b*, 420*b*' may be spaced apart by a suitable distance, such as to accommodate the beam 200 of any selected thickness (e.g., thickness that may be defined by distance between the outer surfaces of the top flange 210 and bottom flange 220). That is, the first seismic fuse plate 410*a* and the second seismic fuse plate 410*b* may be positioned at suitable distance along the column 300 to secure the beam 200 of any selected thickness. Moreover, the beam-to-column connection system 400 may be positioned at any suitable height along the column 300, such that the beam 200 is positioned at a corresponding suitable height.

In the illustrated embodiment, the column 300 is an I-beam that includes flanges 310, 320 and a web 330 therebetween. For example, the column 300 may be axially oriented and/or centered about the axis 10, such that axis 10 is positioned midway between the flanges 310 and 320. In an embodiment, the flanges 310, 320 may be generally perpendicular to the axis 20 that may be generally perpendicular to the axis 10 (e.g., the longitudinal direction of the beam 200 may be generally perpendicular to the outer surfaces of the flanges 310 and 320). It should be appreciated, however, that the beam 200 may have any number of suitable orientations relative to the shape of the column 300 (e.g., relative to the flanges 310 and/or 320). Moreover, the column 300 may have any number of suitable cross-sectional shapes (e.g., tubular rectangle, tubular round, etc.).

In the illustrated example, the first seismic fuse plate 410*a* and seismic fuse plate 410*b* are connected to the column 300 by the first and second pairs of splice plates 420*a*, 420*a*' and the third pair of splice plates 420*b* and fourth splice plates (respectively) that are connected to the doubler plates 440*a*, 440*b*. In particular, in the illustrated embodiment, the 440*a* and 440*b* may be connected to the column 300 with one or more welds (e.g., fillet welds may connect the 440*a* and 440*b* to the flanges 310 and 320). Generally, however, the first seismic fuse plate 410*a* and the second seismic fuse plate 410*b* may be connected to the column 300 with any number of suitable connect systems and mechanism. Examples of suitable connection systems and mechanisms are more fully described in PCT International Application No. PCT/US2015/047006 filed on 26 Aug. 2015, the disclosure of which is incorporated herein in its entirety by this reference.

Figure 2A:
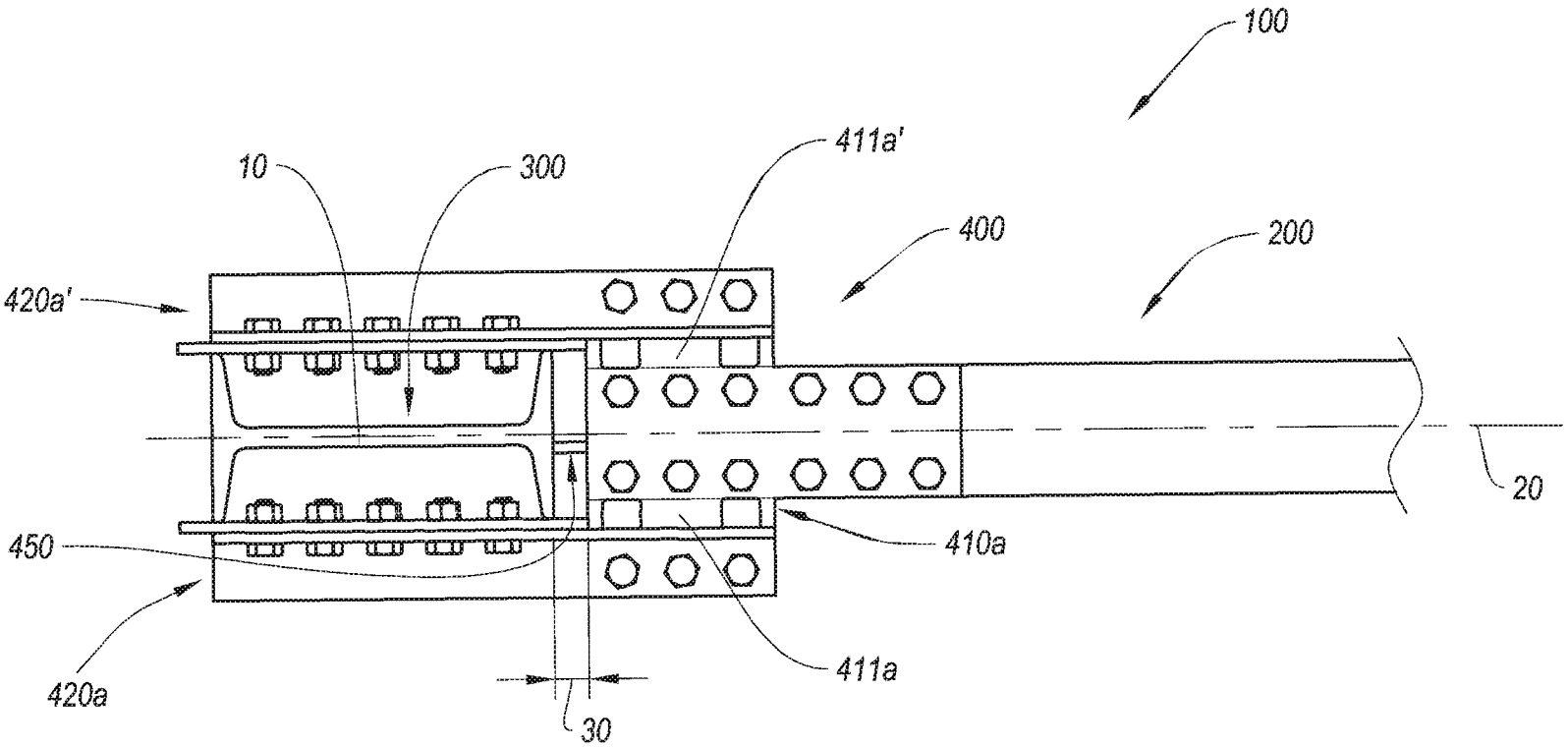
FIG. 2A is a top partial view of the moment-resisting frame of FIG. 1.
Figure 2B:
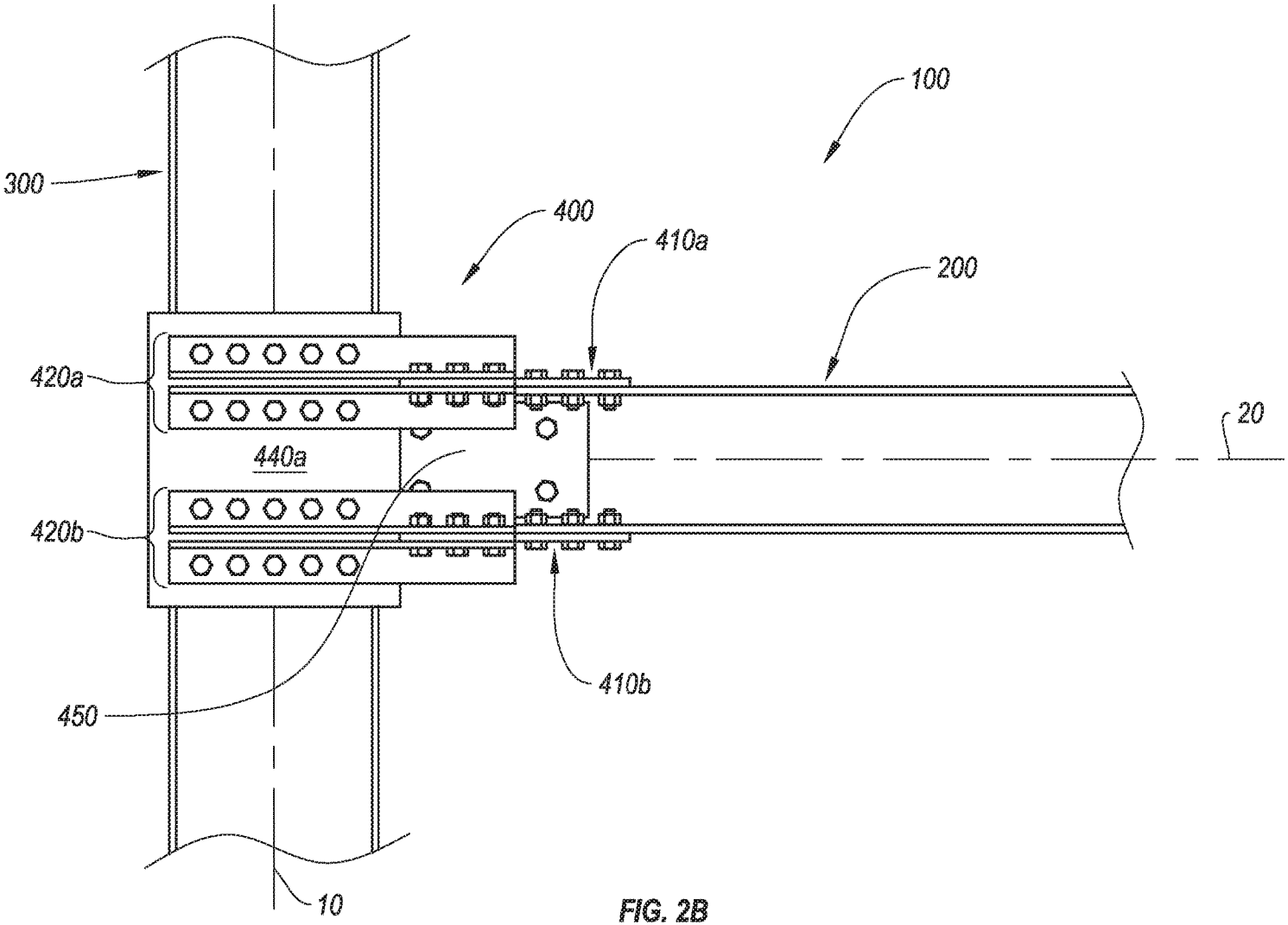
FIG. 2B is a front partial view of the moment-resisting frame of FIG. 1.
Figure 2C:
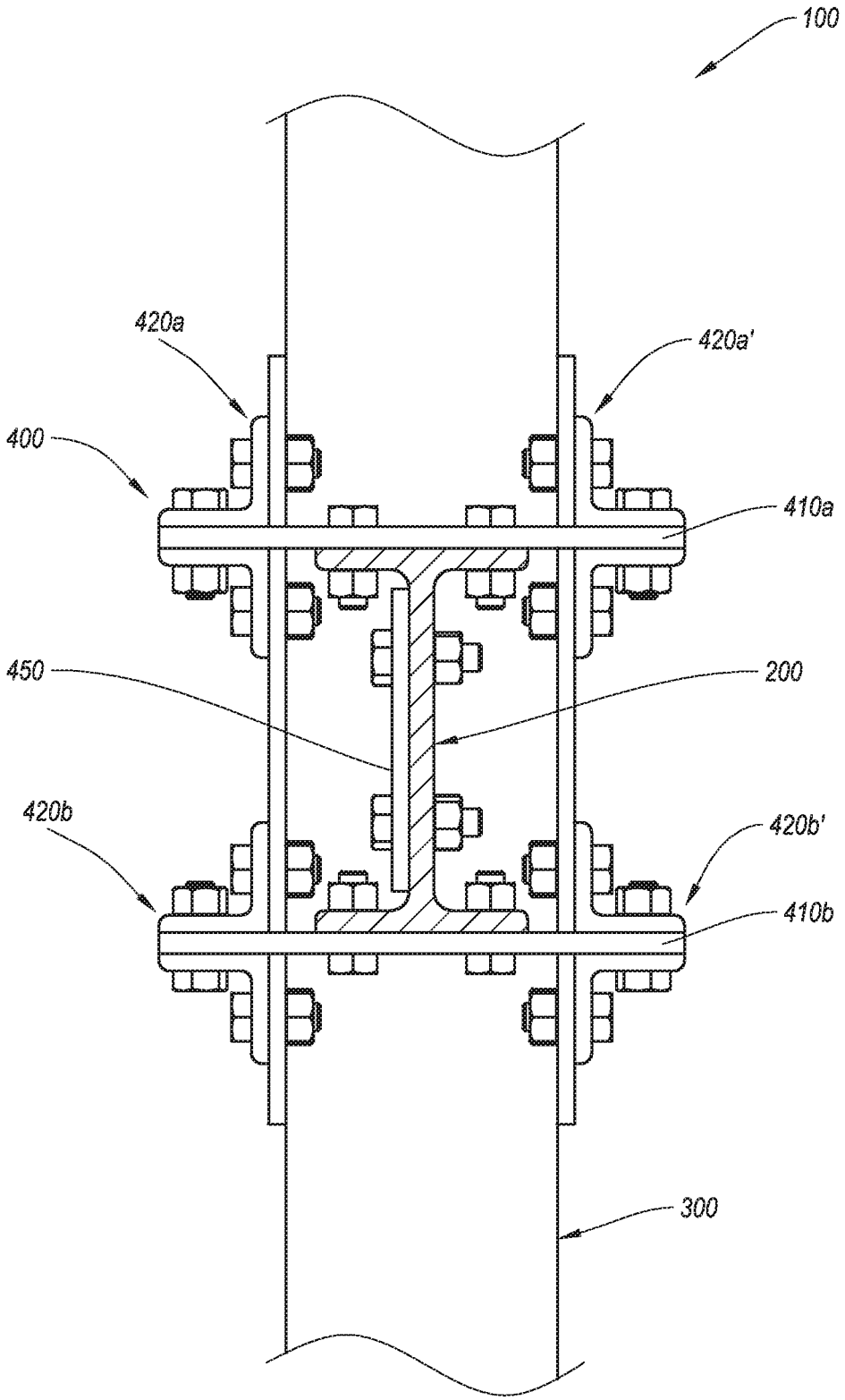
FIG. 2C is an end partial view of the moment-resisting frame of FIG. 1.

FIGS. 2A-2C are partial top, front, and end views, respectively, of the moment-resisting frame 100. Conventionally, the beam secured to the column may have a weakened portioned (e.g., near the connection location) that may fail or plastically deform during a seismic event. For example, conventional moment-resisting frames or frame connections may be configured in a manner that allows one or more portions of the beam to plastically deform, thereby absorbing some of the energy that the seismic event delivered to the moment-resisting frame (e.g., to avoid critical damage to or failure of the frame).

In particular, for example, the first seismic fuse plate 410*a* and the second seismic fuse plate 410*b* may fail or plastically deform, to absorb energy from the seismic event, due to shear forces experience thereby (e.g., forces in a direction generally parallel to the axis 20). As described above, the seismic fuse plate(s), such as the first and second seismic fuse plates 410*a*, 410*b* may absorb some of the energy that a seismic event may deliver to the moment-resisting frame 100. Specifically, for example, dissipating the energy from the seismic event by allowing the seismic fuse plate(s) to deform and/or at least partially shear may prevent or avoid deformations to the beam 200 and/or to the column 300 (e.g., that may otherwise result from the seismic event).

In an embodiment, the beam 200 may be spaced from the column 300 by a space 30. Hence, for example, the first seismic fuse plate 410*a* and the second seismic fuse plate may experience shear forces as the beam 200 moves toward and/or away from the column 300 during a seismic event. As described below in more detail, positioning the beam 200 spaced from the column 300 along the axis 20 (e.g., by a suitable distance) and secured to the column 300 by the beam-to-column connection system 400 may allow the beam 200 to move in a direction that is generally parallel to the axis 20 as the frame tilts. In some embodiments, the axis 20 together with the beam 200 may change orientation relative to the column 300 and relative to the axis 10, as the moment-resisting frame 100 tilts during a seismic event. Furthermore, the beam 200 may apply or produce shear force on the first seismic fuse plate 410*a* and the second seismic fuse plate 410*b*, as the frame tilts and the beam 200 is forced to change orientation relative to the column 300 (e.g., from a generally perpendicular orientation to forming an acute and/or obtuse angle relative thereto).

In some embodiments, the first seismic fuse plate 410*a* and the second seismic fuse plate 410*b* may have similar or the same configurations. Hence, for the sake of simplicity, the following describes to the first seismic fuse plate 410*a*, but would be similarly applicable to the second seismic fuse plate 410*b*. For example, the seismic fuse plate 410*a* may have at least one portion that is wider than the width of the beam 200 (e.g., a portion of the seismic fuse plate 410*a* that is near the column 300 may be wider than the width of the beam 200). Moreover, in some embodiments, the first pair of splice plates 420*a* and the second pair of splice plates 420*a*' may be secured to the seismic fuse plate 410*a* at the portion that is wider than the beam 200 (e.g., the first pair of splice plates 420*a* and the second first pair of splice plates 420*a*' may be positioned about the beam 200 such as to define a distance therebetween that is greater than the width of the beam 200.

In an embodiment, at least one portion of the seismic fuse plate 410*a* may be positioned between the beam 200 one an outer periphery of the beam 200 (e.g., without contacting any other portion of the beam 200, column 300, other portions of the beam-to-column connection system 400, or combination thereof). The seismic fuse plate 410*a* may include first and second shear portions 411*a*, 411*a*'. Specifically, for example, the first shear portion 411*a* may extend between a beam-connection portion (e.g., portion of the seismic fuse plate 410*a* that may be connected to the beam 200) and a splice-connection portion (e.g., portion of the seismic fuse plate 410*a* that is secured between the first pair of splice plates 420*a*). Similarly, the second shear portion 411*a*' may extend between the beam-connection portion (e.g., portion of the seismic fuse plate 410*a* that may be connected to the beam 200) and another splice-connection portion (e.g., portion of the seismic fuse plate 410*a* that is secured between the second pair of splice plates 420*a*'). Hence, under some operating conditions, the first and second shear portions 411*a* and/or 411*a*' may fail, as the beam 200 is forced away from and/or toward the column 300.

In some embodiments, the beam-to-column connection system 400 may include a blocker plate 450 that may prevent or limit movement of the beam 200 toward the column 300. For example, as shown in FIGS. 2A-2C, the blocker plate 450 may be secured to the beam 200 (e.g., to the web of the beam 200) and may abut the column 300 (e.g., may abut the flange of the column 300). In the illustrated example, the blocker plate 450 is fastened to the beam 200 with fasteners. It should be appreciated, however, that the blocker plate 450 may be attached to the beam 200 with any number of suitable connections (e.g., weld, rivets, etc.).

Moreover, the blocker plate 450*a* may be detached from the beam 200. For example, the blocker plate 450*a* may be attached to the beam 200 after the beam 200 is positioned at the suitable location relative to the column 300 (e.g., without the blocker plate 450*a*, the beam 200 may be positioned between two opposing columns, such that the beam 200 is suitably shorter than the distance between the two opposing columns, to facilitate installation of the beam 200). Furthermore, the blocker plate 450 may prevent or limit the beam 200 from moving toward the column 300 but may not stop or limit movement of the beam 200 away from the column 300.

In other words, the blocker plate 450 may provide additional restraint (e.g., in addition to the seismic fuse plate 410*a*) for the beam 200 to move toward the column 300. It should be appreciated, however, that beam 200 may be restrained from moving toward the column 300 with any number additional or alternative elements (e.g., a blocker plate or block may be secured to the column 300 and may abut the end of the beam 200). Moreover, the beam 200 may be sized such that the end of the beam 200 abuts the column 300.

In an embodiment, in a seismic event that applies lateral load onto the moment-resisting frame 100 (e.g., in directions along the axis 20), the seismic fuse plate 410*a* may experience a greater load when the beam 200 experiences forces in the direction away from the column 300 than when the beam 200 experiences forced in the direction toward the column 300. As such, under some operating conditions, the seismic fuse plate 410*a* may be more prone to failure when the beam 200 is forced away from the column 300. In other words, the beam-to-column connection system 400 may be configured such that the seismic fuse plate 410*a* may selectively plastically deform and/or fail in a single direction (e.g., due to shear forces at the first and second shear portions 411*a*, 411*a*'). As described above, in some conventional frames, the beam may be selectively weakened near the connection to the column; such weakened portion may fail in response to repeated compressive and tensile loads thereof (e.g., due to buckling).

Figure 3A:
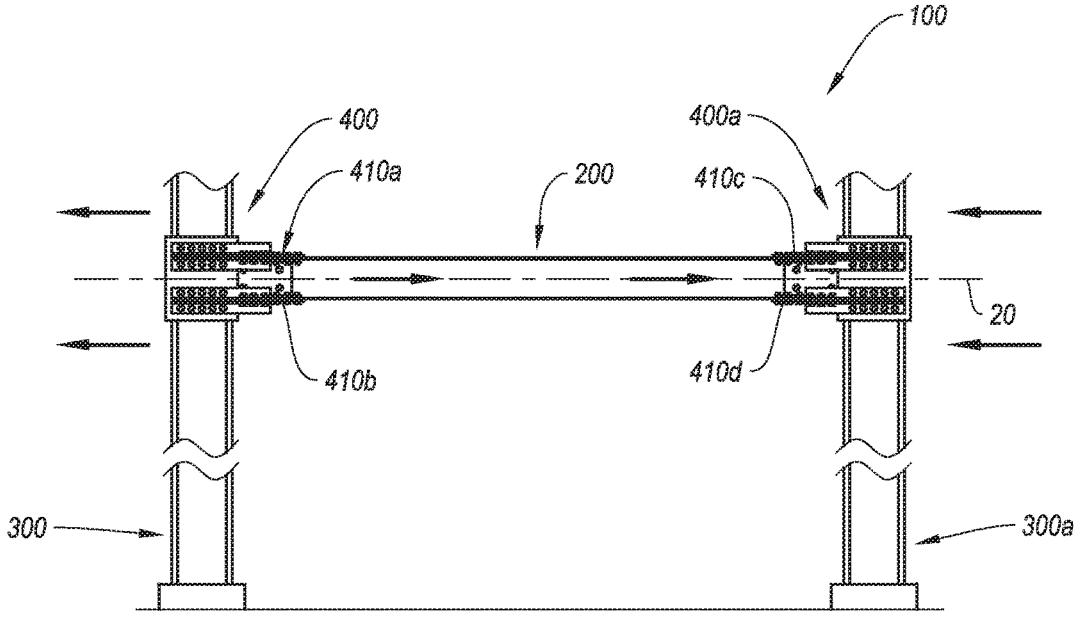
FIG. 3A is a schematic front view of the moment-resisting frame of FIG. 1 under an example load from a seismic event that delivers energy to the moment-resisting frame and causes minimal deformation of a seismic fuse plate that is included in the moment-resisting frame.
Figure 3B:
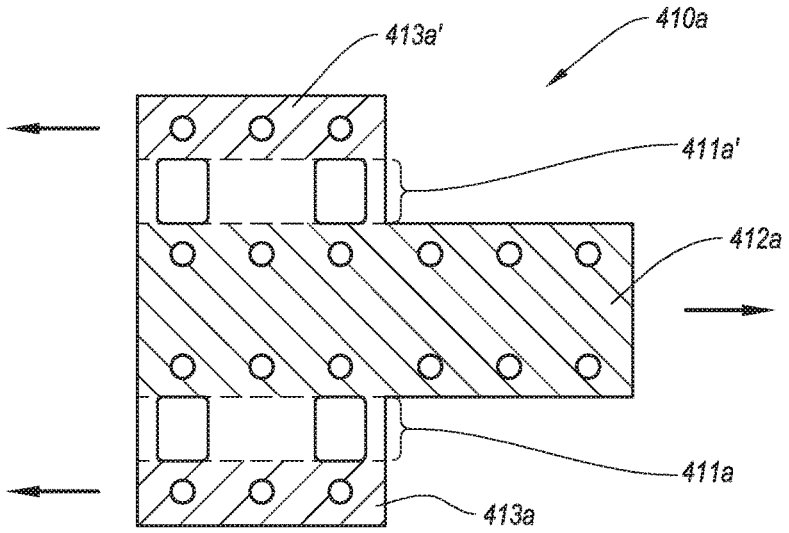
FIG. 3B is a top view of the seismic fuse plate exposed to the loads shown in FIG. 3A.

FIG. 3A is a schematic front view of the moment-resisting frame 100 under an example load from a seismic event. FIG. 3B shows the forces experienced by the seismic fuse plate 410*a* of the beam-to-column connection system 400, according to the loading shown in FIG. 3A. The moment-resisting frame 100 may experience a seismic event that may produce lateral forces that generally push the moment-resisting frame 100 laterally to the left (as shown in FIG. 3A) and/or in the opposite direction, to the right.

The moment-resisting frame 100 may include a beam 200 connected to and between opposing columns 300 and 300*a*, thereby forming a substantially rigid structure that may resist lateral forces (e.g., the moment-resisting frame 100 may be included in a structure, such as a building, and may provide suitable resistance to lateral movements, which may prevent collapse of the building under certain conditions). As described above, the beam 200 may be connected to the column 300 by the beam-to-column connection system 400. Furthermore, the beam 200 may be connected to the column 300*a* by a beam-to-column connection system 400*a* that may be similar to or the same as the beam-to-column connection system 400 (e.g., as described above).

In the illustrated example, the beam-to-column connection system 400 includes the seismic fuse plate 410*a* and seismic fuse plate 410*b* that experience shear load (as shown in FIG. 3B in connection with the 410*a*). Conversely, the beam-to-column connection system 400*a* may include seismic fuse plate 410*c* and seismic fuse plate 410*d* (that may be similar to or the same as the respective seismic fuse plate 410*a* and seismic fuse plate 410*b*), which may experience compressive load. Moreover, as mentioned above, the beam-to-column connection system 400 and/or the beam-to-column connection system 400*a* may include one or more blocker plates that may provide additional compressive strength to the beam-to-column connection system 400 (e.g., the seismic fuse plate 410*a* and seismic fuse plate 410*b* may experience greater shear loads than the shear loads experienced by the seismic fuse plate 410*c* and seismic fuse plate 410*d*).

As described above, the seismic fuse plate 410*a* may include the shear portions 411*a* and 411*a*' that may be positioned and configured such as not to contact any other portion of the beam 200, column 300, beam-to-column connection system 400, or combinations thereof. For example, the seismic fuse plate 410*a* may include a beam-connection portion 412 that may generally extend along the middle of the seismic fuse plate 410*a* and may be connected to the beam. The seismic fuse plate 410*a* also may include a first splice-connection portion 413*a* and a second splice-connection portion 413*a*'. In an embodiment, the first splice-connection portion 413*a* may be secured to the first pair of splice plates and the second splice-connection portion 413*a*' may be secured to the second pair of splice plates. For ease of identification, FIG. 3B illustrates the first and second shear portions 411*a* and 411*a*' without any shading, the beam-connection portion 412*a* is shown with a first cross-hatch, and the first and second splice-connection portion 413*a*, 413*a*' are shown with a second cross-hatch (the cross-hatches only demarcate the respective portions and are not used to indicate a cross-section at the cross-hatched locations).

In an embodiment, the first and second shear portions 411*a* and 411*a*' may be positioned between the portions of the seismic fuse plate 410*a*, which may be secured to the beam or to the column. For example, the first shear portion 411*a* may be positioned between the beam-connection portion 412*a* (secured to the beam) and the first splice-connection portion 413*a* (secured to the first pair of splice plates). Likewise, the second shear portion 411*a*' may be positioned on an opposite side of the seismic fuse plate 410*a* and between the beam-connection portion 412*a* (secured to the beam) and the second splice-connection portion 413*a*' (secured to the second pair of splice plates).

Hence, for example, as the beam 200 and the column 300 experience forces in the opposite directions (as shown in FIGS. 3A-3B), the beam-connection portion 412*a* on the one hand and the first splice-connection portion 413*a* and second splice-connection portion 413*a*' on the other hand may experience the same forces as the beam 200 and the column 300, respectively (translated thereto through the splice plates and the beam connection). Moreover, as the first shear portion 411*a* is positioned between the beam-connection portion 412 and the 413*a*, the first shear portion 411*a* may experience shear forces. Similarly, as the second shear portion 411*a*' is positioned between the beam-connection portion 412 and the 413*a*, the second shear portion 411*a*' may experience shear forces (e.g., which may be similar to or the same as the shear forces experienced at the first shear portion 411*a*).

Figure 4A:
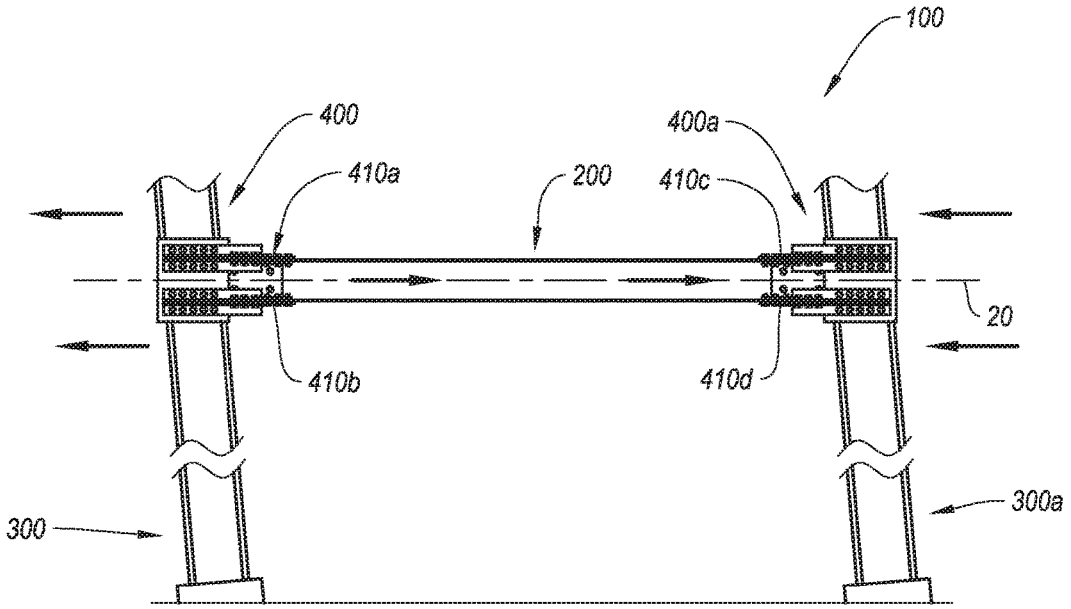
FIG. 4A is a schematic front view of the moment-resisting frame of FIG. 1 under another example load from a seismic event that delivers energy to the moment-resisting frame and causes plastic deformation or failure of a seismic fuse plate that is included in the moment-resisting frame.
Figure 4B:
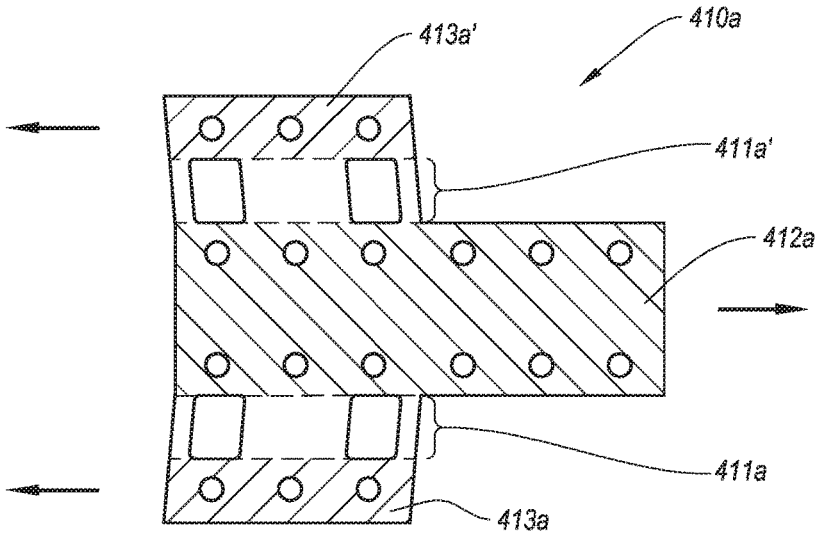
FIG. 4B is a top view of the seismic fuse plate exposed to the loads shown in FIG. 4A.

FIG. 4A is a schematic illustration that shows the moment-resisting frame 100 after the seismic fuse plate 410*a* and the seismic fuse plate 410*b* deform (e.g., plastically or elastically deform) to facilitate lateral tilting of the moment-resisting frame 100. It should be appreciated that the moment-resisting frame 100 is not shown to scale in FIG. 4A. FIG. 4B the deformation of the seismic fuse plate 410*a* resulting from the tilt of the moment-resisting frame 100 shown in FIG. 4A. In particular, as shown in FIG. 4B, the first and second shear portions 411*a* and 411*a*' may be deformed (plastically or elastically) due to the shear stress experienced thereat.

Generally, the amount of deformation and/or the forces required to produce the deformation (e.g., such as to plastically deform or fail the first and second shear portions 411*a* and/or 411*a*' of the seismic fuse plate 410*a* and/or corresponding portions of the seismic fuse plate 410*b*) may vary from one embodiment to the next and may depend on the shape and size of the first and second shear portions 411*a*, 411*a*', modulus of elasticity of the material of the seismic fuse plate 410 and/or material of the first and second shear portions 411*a*, 411*a*', etc.

As described above, in some embodiment, the moment-resisting frame may have two or more beam-to-column connection systems that include at least one seismic fuse plate (e.g., two opposing beam-to-column connection systems). Additionally or alternatively, moment-resisting frames may include a single beam-to-column connection system with at least one seismic fuse plate. For example, a moment-resisting frame may include two opposing columns and a beam connected thereto; a beam-to-column connection system (e.g., as described above) may connect the beam to a first column, and another connection (e.g., another rigid connection, such as a welded connection) may connect the beam to a second column.

Figure 5:
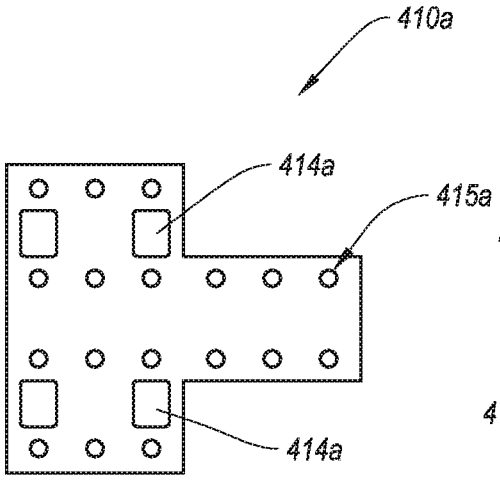
FIG. 5 is a top view of a seismic fuse plate, according to an embodiment.

The seismic fuse plate 410*a* may have a plate-like configuration of a selected thickness. For example, the thickness of the seismic fuse plate 410*a* may be selected such that the first and second shear portions 411*a* and 411*a*' have a suitable or selected failure point or force at which the first and second shear portions 411*a* and 411*a*' plastically deform. FIG. 5 is a top view of the seismic fuse plate 410*a* according to an embodiment. As shown in FIG. 5 the seismic fuse plate 410*a* may have openings 414*a* extending through the thickness of the seismic fuse plate 410*a*. In particular, for example, the openings 414*a* may weaken the first and second shear portions 411*a* and 411*a*', such that the first and second shear portions 411*a* and 411*a*' have suitable strength (e.g., such that the first and second shear portions 411*a* and 411*a*' may deform to absorb energy of a seismic event and prevent deformation or damage to the beam and/or column connected thereby). In some embodiments, the shear portions may have other suitable shapes and sizes, as described below.

Also, as described above, the seismic fuse plate 410*a* may be fastened to the beam and to the splice plates. Hence, for example, the seismic fuse plate 410*a* may include fastener holes 415*a* at suitable locations for fastening the seismic fuse plate 410*a*. Generally, however, the seismic fuse plate 410*a* may be fastened to the beam and to the splice plates with any number of suitable connections (e.g., weld, rivets, etc.). In some embodiments, the seismic fuse plate may have no holes or openings for fasteners.

Figure 6:
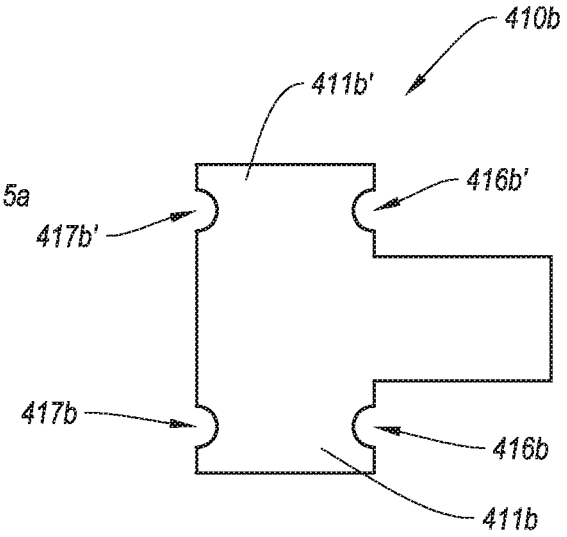
FIG. 6 is a top view of a seismic fuse plate, according to another embodiment.

It should be appreciated, however, that the shear portions of the seismic fuse plate may have any number of suitable configurations. FIG. 6 is a top view of a seismic fuse plate 410*b* according to an embodiment. Except as otherwise described herein, the seismic fuse plate 410*b* may be similar to or the same seismic fuse plate 410*a* (FIG. 5). For example, the seismic fuse plate 410*b* may include first and second shear portions 411*b* and 411*b*' that may be defined by one or more cutouts extending from the edges of the seismic fuse plate 410*b* (e.g., by the cutouts 416*b*, 417*b* and cutouts 416*b*', 417*b*', respectively).

Figure 7A:
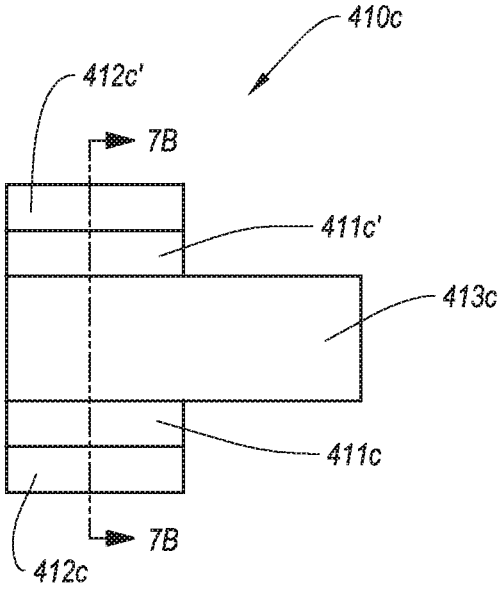
FIG. 7A is a top view of a seismic fuse plate, according to yet another embodiment.
Figure 7B:
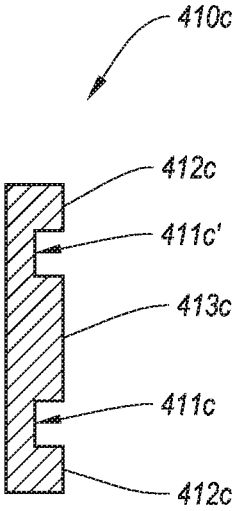
FIG. 7B is a cross-sectional view of the seismic fuse plate of FIG. 7A.

Moreover, in some embodiments, the shear portions may have a smaller thickness than other portions of the seismic fuse plate. FIG. 7A is a top view of a seismic fuse plate 410*c* according to an embodiment. FIG. 7B is a cross-sectional view of the seismic fuse plate 410*c*, as indicated in FIG. 7A. Except as otherwise described herein, the seismic fuse plate 410*c* may be similar to or the same any of the seismic fuse plates 410*a*, 410*b* (FIGS. 5-6). For example, the seismic fuse plate 410*c* may include first and second shear portions 411*c*, 411*c*' that may have one or more portions with smaller thicknesses than beam-connection portion 412*c* and/or first and second splice-connection portions 413*c*, 413*c*'.

Furthermore, the seismic fuse plate may have any number of suitable configurations. In an embodiment, where the shear portions 411*c*, 411*c*' of the seismic fuse plate may have selected strength, such as to produce a controlled plastic deformation and/or failure thereat. For example, the shear portions 411*c*, 411*c*' may have a suitable or selected thickness, such that the shear portions 411*c*, 411*c*' may deform or fail in response to selected shear forces applied thereto.

Figure 8:
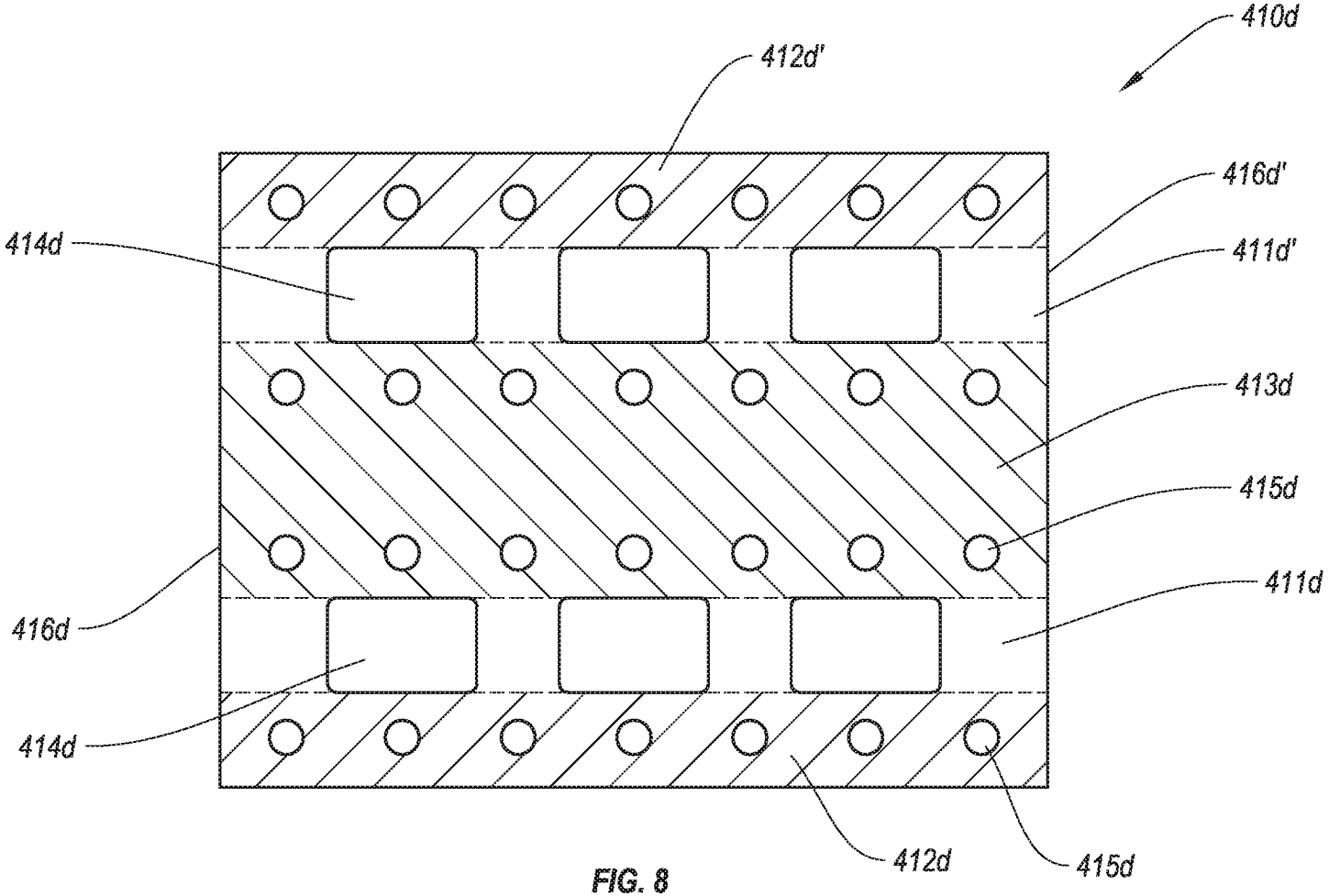
FIG. 8 is a top view of a seismic fuse plate, according to another embodiment.

FIG. 8 is a top view of a seismic fuse plate 100*d*, according to an embodiment. Except as otherwise described herein, the seismic fuse plate 410*d* may be similar to or the same any of the seismic fuse plates 410*a*, 410*b*, 410*c* (FIGS. 5-7B). For example, the seismic fuse plate 100*d* may have first and second shear portions 411*d*, 411*d*', a beam-connection portion 412*d*, and first and second splice-connection portions 412*d*, 412*d*', which may be similar to the respective first and second shear portions 411*a*, 411*a*', a beam connection portion 412*a*, and first and second splice-connection portions 412*a*, 412*a*' of the seismic fuse plate 100*d* (FIG. 3B). In the illustrated example, the first and second shear portions 411*d*, 411*d*', the beam-connection portion 412*d*, and first and second splice-connection portions 412*d*, 412*d*' may have generally the same lengths (e.g., may extend between opposing edges 416*d*, 416*d*' of the seismic fuse plate 410*d*). Moreover, it should be appreciated that the first and second shear portions 411*d*, 411*d*', the beam-connection portion 412*d*, and first and second splice-connection portions 412*d*, 412*d*' may have any suitable widths (e.g., dimensions or sized that are generally perpendicular to the respective lengths). For example, the width of the beam-connection portion 413*d* may be generally the same as the width of one or more flanges of a beam. Moreover, the first and second shear portions 411*d*, 411*d*', the beam-connection portion 412*d*, and first and second splice-connection portions 412*d*, 412*d*' may have substantially the same widths as one another or different widths.

In the illustrated embodiments in FIGS. 2A-8, the first and second seismic fuse plates (e.g., the first and second seismic plates 410*a*, 410*b* shown in FIGS. 2A-2B) include openings or cutouts therein. However, in other embodiments, one or both of the first or second seismic fuse plates of any of the moment-resistant frames and beam-to-column connection systems may lack the openings or the cutouts and may be generally imperforate.

While various aspects and embodiments have been disclosed herein, other aspects and embodiments are contemplated. The various aspects and embodiments disclosed herein are for purposes of illustration and are not intended to be limiting.

What is claimed is:

1. A beam-to-column connection system, comprising:

a first pair of splice plates configured to be secured to the column and to be spaced from each other along the column at a first distance;

a second pair of splice plates configured to be secured to the column and opposite to the first pair of splice plates, and to be spaced from each other along the column at the first distance;

a first seismic fuse plate including:

a beam-connection portion configured to connect to a first flange of the beam;

a first splice-connection portion longitudinally extending along at least a portion of the beam-connection portion and being configured to connect to and between the first pair of splice plates at a first location;

a second splice-connection portion longitudinally extending along at least a portion of the beam-connection portion and being configured to connect to and between the second pair of splice plates at a second location, the distance between the first and second locations being greater than the width of the beam; and a first shear portion extending between the first splice-connection portion and the beam-connection portion, the first shear portion configured to selectively fail during a seismic event.

2. The beam-to-column connection system of claim 1, wherein the first seismic fuse plate includes a second shear portion extending between the second splice-connection portion and the beam-connection portion.

3. The beam-to-column connection system of claim 1, wherein the first shear portion has one or more openings extending therethrough.

4. The beam-to-column connection system of claim 1, wherein:

one or more of the first splice-connection portion or the second splice-connection portion of the first seismic fuse plate have one or more openings extending therethrough; and one or more of the first pair of splice plates or the second splice plates have one or more openings extending therethrough and corresponding to the openings in the first or second splice-connection portions of the first seismic fuse plate.

5. The beam-to-column connection system of claim 1, further comprising a first doubler plate sized and configured to be secured to the column, the first pair of splice plates being configured to be secured to the first doubler plate.

6. The beam-to-column connection system of claim 5, wherein:

the first pair of splice plates have one or more openings; and the first doubler plate has one or more openings that correspond to the one or more openings of the first pair of splice plates.

7. The beam-to-column connection system of claim 1, further comprising:

a third pair of splice plates configured to be secured to the column and to be spaced from each other along the column at a second distance;

a four pair of splice plates configured to be secured to the column and to be spaced from each other along the column at the second distance;

a second seismic fuse plate including:

a beam-connection portion configured to connect to a second flange of the beam;

a first splice-connection portion longitudinally extending along at least a portion of the beam-connection portion and being configured to connect to and between the third pair of splice plates;

a second splice-connection portion longitudinally extending along at least a portion of the beam-connection portion and being configured to connect to and between the fourth pair of splice plates at a second location, the distance between the first and second location being greater than the width of the beam; and a first shear portion extending between the first splice-connection portion and the beam-connection portion.

8. The beam-to-column connection system of claim 7, further comprising:

a first doubler plate sized and configured to be secured to the column, the first pair of splice plates being configured to be secured to the first doubler plate; and a second doubler plate sized and configured to be secured to the column, the second pair of splice plates being configured to be secured to the first doubler plate.

9. A moment-resisting frame, comprising:

a column having a column width;

a beam having a beam width; and a beam-to-column connection system connecting the beam to the column, the beam-to-column connection system including:

a first pair of splice plates connected to a first side of the column and spaced from each other along the first side of the column at a first distance;

a second pair of splice plates connected to a second side of the column and spaced from each other along the first side of the column at the first distance;

a first seismic fuse plate secured between the first pair of splice plates and between the second pair of splice plates, the first seismic fuse plate including:

a beam-connection portion connected to a first flange of the beam; and a first shear portion located between the beam-connection portion and the first pair of splice plates, the first shear portion configured to selectively fail during a seismic event.

10. The moment-resisting frame of claim 9, wherein the first seismic fuse plate is fastened to the first pair of splice plates and to the second pair of splice plates.

11. The moment-resisting frame of claim 9, wherein the first shear portion has one or more openings extending therethrough.

12. The moment-resisting frame of claim 9, wherein the beam-to-column connection system includes a first doubler plate that is secured to a first side of the beam, the first pair of splice plates being secured to the doubler plate.

13. The moment-resisting frame of claim 12, wherein the beam-to-column connection system includes a second doubler plate that is secured to a second side of the beam, the second pair of splice plates being secured to the doubler plate.

14. The moment-resisting frame of claim 13, wherein the first and second doubler plates are welded to the column.

15. The moment-resisting frame of claim 13, wherein the beam-to-column connection system includes:

a third pair of splice plates secured to the first doubler plate;

a fourth pair of splice plates secured to the second doubler plate; and a second seismic fuse plate including a beam-connection portion secured between the third and fourth splice plates and secured to a second flange of the beam.

16. The moment-resisting frame of claim 15, wherein the second seismic fuse plate includes a first shear portion located between the beam-connection portion and the third pair of splice plates.

17. The moment-resisting frame of claim 15, wherein at least one of the first and third pairs of splice plates are fastened to the first doubler plate.

18. The moment-resisting frame of claim 9, wherein the first seismic fuse plate includes a second shear portion located between the beam-connection portion and the second pair of splice plates.

19. The moment-resisting frame of claim 18, wherein the second shear portion has one or more openings extending therethrough.

20. The moment-resisting frame of claim 9, further comprising another column, the beam being connected to the another column.

21. The moment-resisting frame of claim 9, further comprising another beam-to-column connection system connecting the beam to the another column, the beam-to-column connection system including:

a first pair of splice plates connected to a first side of the column and spaced from each other along the first side of the column at a first distance;

a second pair of splice plates connected to a second side of the column and spaced from each other along the first side of the column at the first distance;

a first seismic fuse plate secured between the first pair of splice plates and between the second pair of splice plates, the first seismic fuse plate including:

a beam-connection portion connected to a first flange of the beam; and a first shear portion located between the beam-connection portion and the first pair of splice plates.

* * * * *